US011578616B2

(12) United States Patent
Fokin et al.

(10) Patent No.: US 11,578,616 B2
(45) Date of Patent: Feb. 14, 2023

(54) GAS TURBINE ENGINE ASSEMBLY AND METHOD OF DISASSEMBLING SAME

(71) Applicant: PRATT & WHITNEY CANADA CORP., Longueuil (CA)

(72) Inventors: Dmitrii Fokin, Longueuil (CA); Audrey Brouillet, Saint-Basile-le-Grand (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 86 days.

(21) Appl. No.: 17/168,920

(22) Filed: Feb. 5, 2021

(65) Prior Publication Data

US 2022/0251973 A1 Aug. 11, 2022

(51) Int. Cl.
*F01D 25/24* (2006.01)

(52) U.S. Cl.
CPC ..... *F01D 25/24* (2013.01); *F05D 2220/32* (2013.01); *F05D 2230/70* (2013.01); *F05D 2260/37* (2013.01)

(58) Field of Classification Search
CPC ..... F01D 25/24; F01D 9/064; F01D 25/125; F01D 17/00; F01D 17/141; F01D 17/162; F01D 17/165; F01D 25/08; F05D 2220/32; F05D 2230/70; F05D 2260/37
See application file for complete search history.

(56) References Cited

U.S. PATENT DOCUMENTS

| | | | | |
|---|---|---|---|---|
| 4,007,535 | A * | 2/1977 | Brandt | B25B 27/023 29/261 |
| 2005/0005413 | A1* | 1/2005 | Smith | B25B 27/06 29/426.5 |
| 2005/0132554 | A1* | 6/2005 | Bridges | F16C 33/60 29/256 |
| 2010/0101065 | A1* | 4/2010 | Macchia | F04D 7/065 29/259 |
| 2012/0151735 | A1* | 6/2012 | Thomas | B25B 27/062 29/283 |
| 2013/0266421 | A1 | 10/2013 | Benjamin et al. | |
| 2019/0001472 | A1* | 1/2019 | Wojciechowski | B25B 27/026 |
| 2019/0353182 | A1* | 11/2019 | Williamson | B23P 19/025 |

FOREIGN PATENT DOCUMENTS

| | | |
|---|---|---|
| EP | 2584153 | 4/2013 |
| EP | 3032030 | 6/2016 |
| EP | 3232009 | 10/2017 |

* cited by examiner

*Primary Examiner* — Igor Kershteyn
(74) *Attorney, Agent, or Firm* — Norton Rose Fulbright Canada LLP

(57) ABSTRACT

The gas turbine engine assembly can include a first component having a male fit perimeter, a second component having a female fit perimeter forming an interference fit with the male fit perimeter, one of the first component and the second component having a pulling lip spanning transversally and further spanning peripherally, and a structure holding the pulling lip transversally offset from the interference fit, the structure having a bending portion extending at least partially transversally.

20 Claims, 7 Drawing Sheets

GAS TURBINE ENGINE ASSEMBLY AND METHOD OF DISASSEMBLING SAME

TECHNICAL FIELD

The application relates generally to gas turbine engines and, more particularly, to the design of components thereof which are assembled to one another by a tight fit.

BACKGROUND OF THE ART

Gas turbine engines typically have a large number of components which are assembled to one another in various ways such as bolting through flanges, welding, and in some cases, interference-fitting, also known as "tight fits" or "friction fits". During engine design, the particular assembly technique which is retained for the assembly of two components to one another can be affected by various considerations, such as weight, cost, reliability and structural strength, and can also depend on the position and use of the component in the gas turbine engine, which can affect the forces and stresses which can be expected during typical conditions of use or extreme conditions. In some cases, it is desired to provide the components with the capacity of being disassembled in a relatively simple manner. This "disassembly-ability" can be required when, for instance, one of the components in question is expected to need to be removed when certain expectable or planned maintenance activities are to be performed. Fastening, by means of bolts, interference-fitting, or other, is typically considered to be of the disassemble-able type, whereas welding or brazing are typically not considered to be of the disassemble-able type.

While known assembly techniques methods were satisfactory to a certain degree, there always remains room for improvement.

SUMMARY

In one aspect, there is provided a gas turbine engine assembly comprising: a first component having a male fit perimeter; a second component having a female fit perimeter forming an interference fit with the male fit perimeter, the interference fit having a fit perimeter and a length; one of the first component and the second component having a pulling lip spanning transversally, relative to an orientation of the length, and further spanning peripherally, and a structure holding the pulling lip transversally offset from the interference fit, the structure having a bending portion extending at least partially transversally.

In another aspect, there is provided a method of disassembling a gas turbine engine assembly comprising: exerting a pulling force to a pulling lip of a first component relative to a second component, the first component having a fit perimeter interference fitted with a fit perimeter of the second component, said pulling force bending a structure extending between the pulling lip and the interference fit, said bending moving the fit perimeter of the first component away from the fit perimeter of the second component, thereby weakening the interference fit, and removing the first fit perimeter from the second fit perimeter while the interference it is weakened.

In a further aspect, there is provided a gas turbine engine comprising: a first component having a male fit perimeter; a second component having a female fit perimeter forming an interference fit with the male fit perimeter, the interference fit having a fit perimeter and a length; one of the first component and the second component having a pulling lip spanning transversally, relative to an orientation of the length, and further spanning peripherally, and a structure holding the pulling lip transversally offset from the interference fit, the structure having a bending portion extending at least partially transversally.

DESCRIPTION OF THE DRAWINGS

Reference is now made to the accompanying figures in which:

FIG. 6 is another graph representing simulations illustrating the effect of the extent of an offset on the disassembly operation.

DETAILED DESCRIPTION

Figure 1:
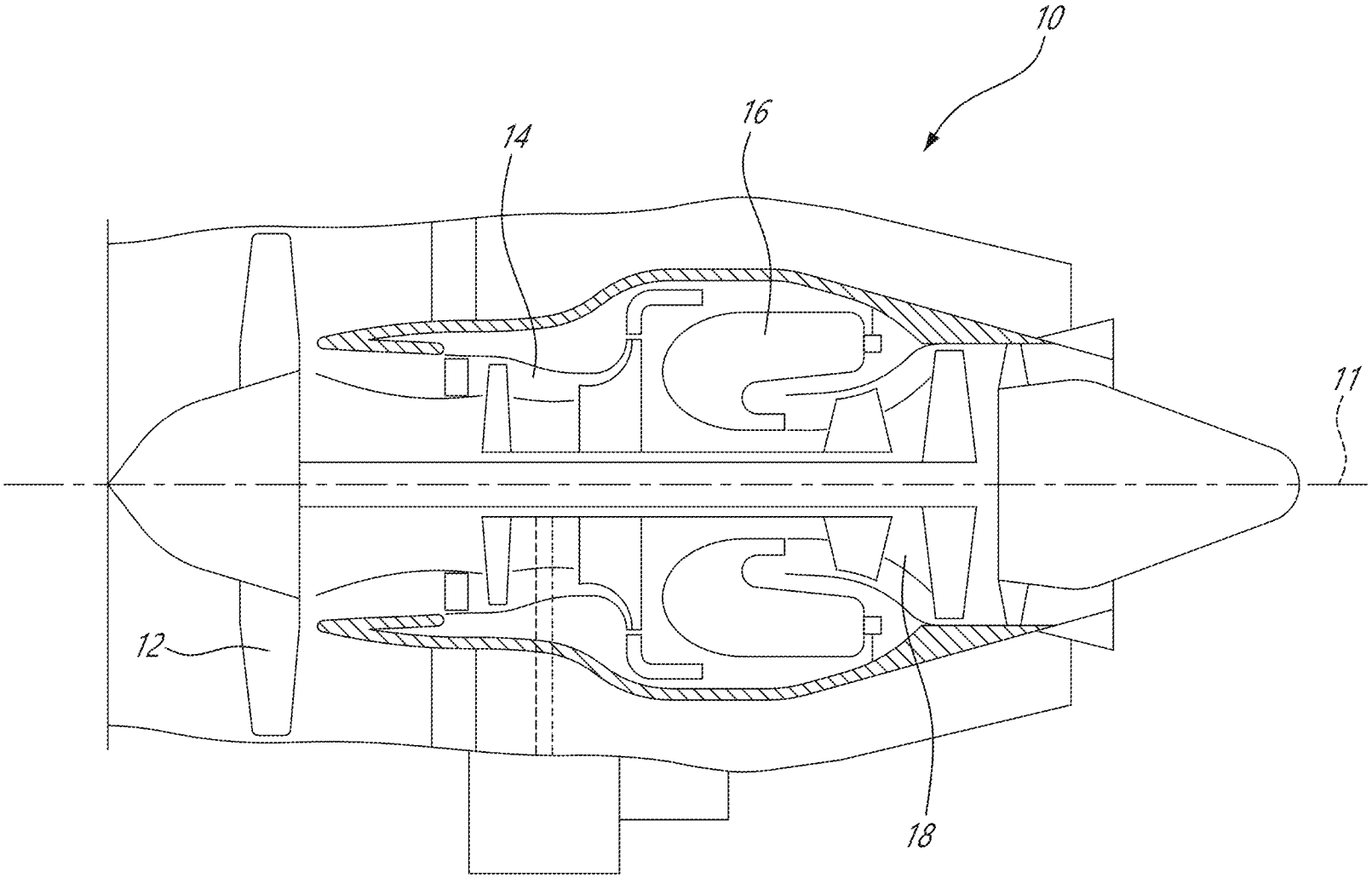
FIG. 1 is a schematic cross-sectional view of a gas turbine engine.

FIG. 1 illustrates a gas turbine engine 10 of a type preferably provided for use in subsonic flight, generally comprising in serial flow communication a fan 12 through which ambient air is propelled, a compressor section 14 for pressurizing the air, a combustor 16 in which the compressed air is mixed with fuel and ignited for generating an annular stream of hot combustion gases around the engine axis 11, and a turbine section 18 for extracting energy from the combustion gases.

Gas turbine engines can have a large number of components which are assembled to one another in various ways such as bolting through flanges, welding, and in some cases, interference-fitting, also referred to as "tight fits". In some embodiments, the tight fit technique can be advantageous over bolting through flanges due to the fact that it can allow achieving lower weight, and in some cases, lower costs as well, while remaining satisfactory from the point of view of other design considerations.

Figure 2:
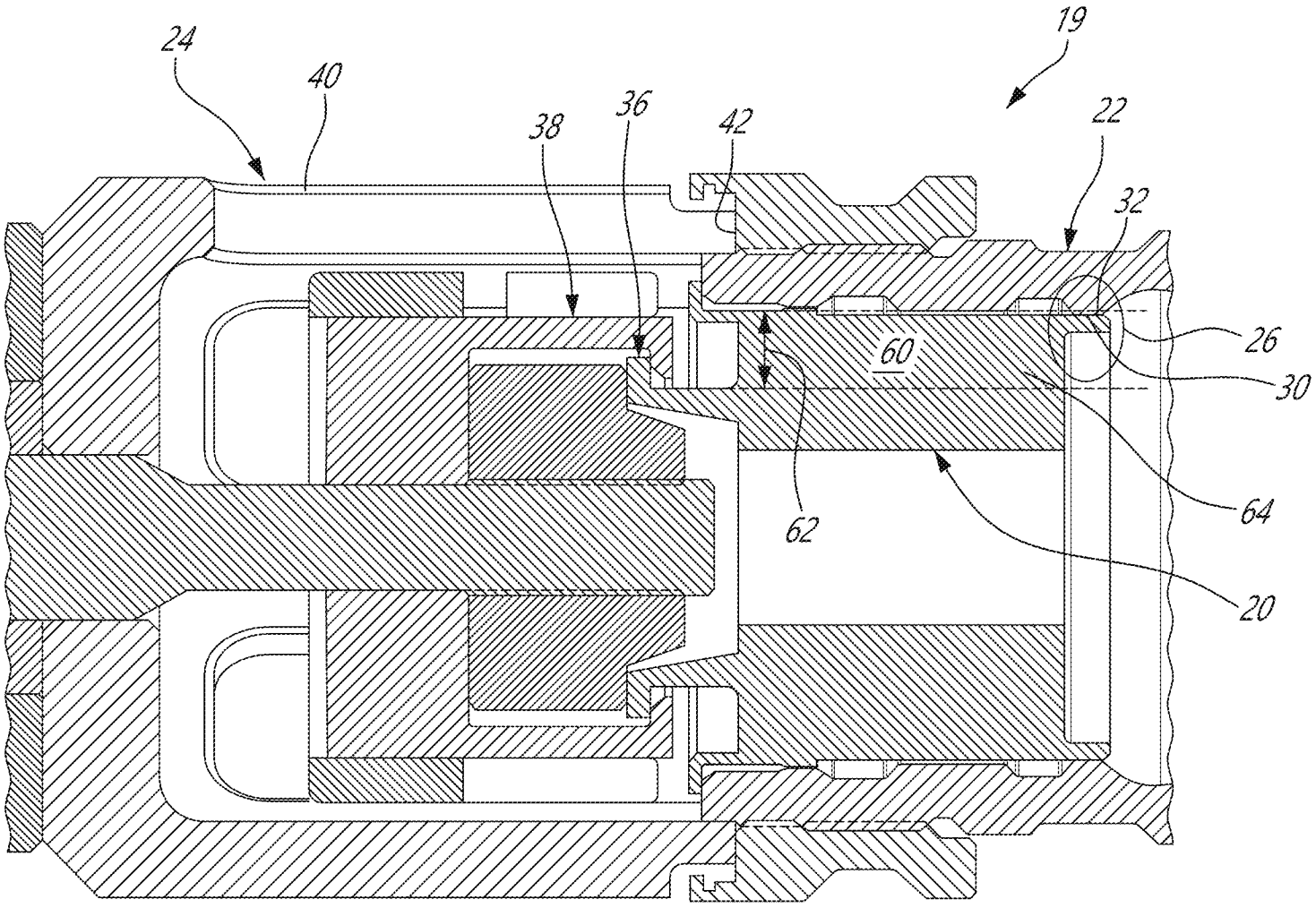
FIG. 2 is a cross-sectional view of a first embodiment of two interference-fitted components in the process of being disassembled by a tool.

FIG. 2 schematizes an assembly 19 of a gas turbine engine 10 including a first component 20 fastened to a second component 22 by interference fitting, during a disassembly operation with a tool. The interference fit 26, is achieved here by press-fitting a male fit perimeter 30 of the first component 20, having a slightly larger diameter, into a corresponding female fit perimeter 32 of the second component 22, having a slightly smaller diameter, forcefully enough to cause the first and second components 20, 22 the locally elastically deform and accommodate the interference fit 26, or by otherwise exerting forces which allow to overcome the friction generated at the perimeters 32, 30 of the engaged components 20, 22. By providing the components 20, 22 which are tight-fitted to one another with appropriate features, the components 20, 22 can be conveniently made removable from one another with appropriate tooling, such as a "puller" 24, and can thus be considered as providing more disassembly-ability than, say, welding. The puller 24 can have one component 38 which grabs onto a corresponding "pulling" feature 36 of the first component 20 (referred to hereinafter simply as pulling lip 36), and retracts under a pulling force, with the first component 20, within a housing 40 which has a pushing feature 42 which remains in abutment with a corresponding feature of the second component 22 during the operation, with an amount of force sufficient to overcome the resisting friction force of the engaged perimeters. The pulling force can be exerted via a mechanism linking the grabbing component 38 and the housing 40. The mechanism can be as simple as an endless screw mechanism, or more elaborated, depending on the embodiment.

Figure 3:
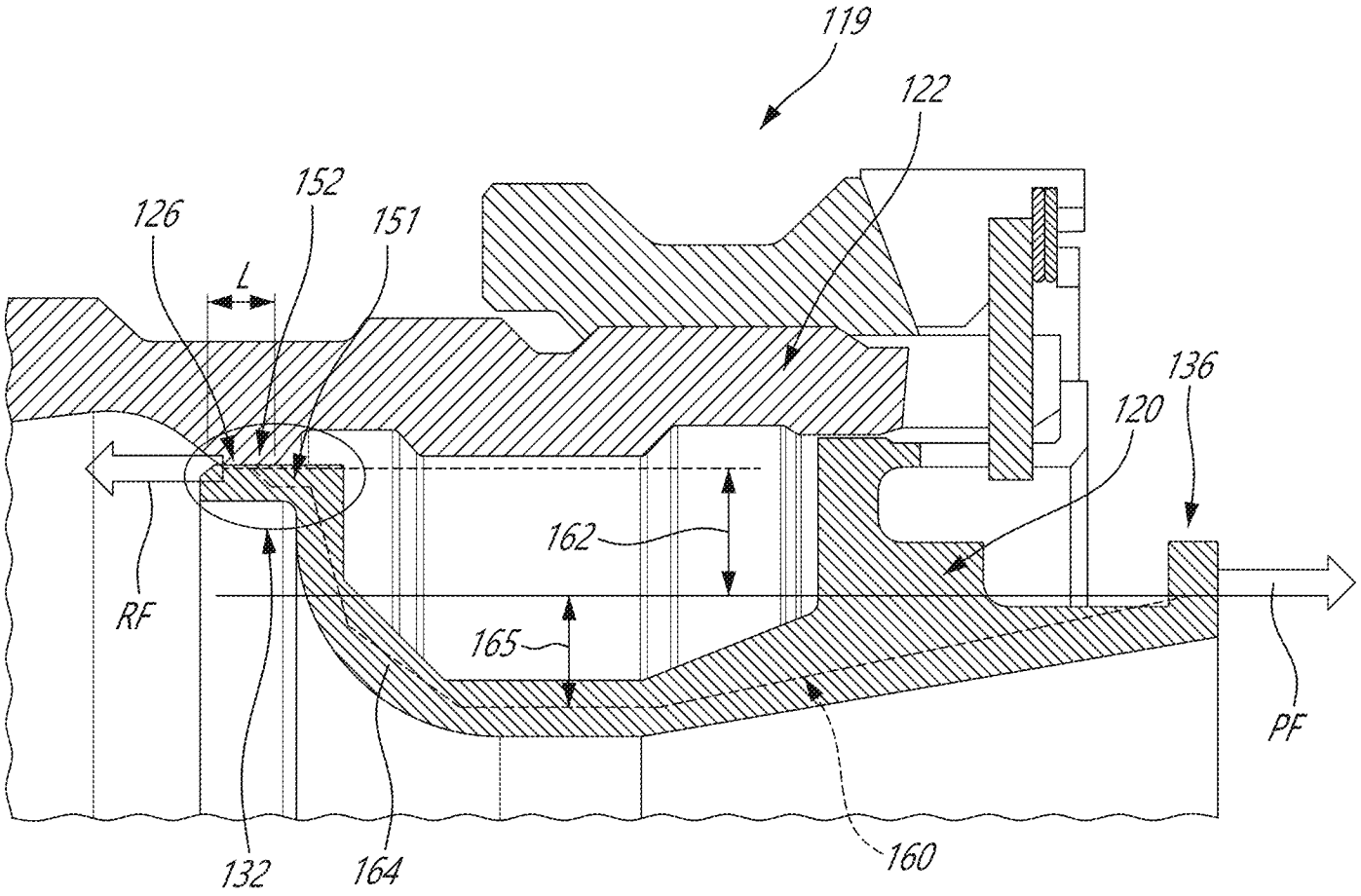
FIG. 3 is a cross-sectional view of a second embodiment of two interference-fitted components.

FIG. 3 presents a second example of a gas turbine engine assembly 119 including a first component 20 which is assembled to a second component 22 via an interference fit 126. The interference fit 126 can be said to have fit perimeter, corresponding to the coinciding portions of the male fit perimeter 154 and female fit perimeter 152, and a length L. The shape of the interference fit 126 can vary depending on the embodiment. If the interference fit 126 has a cylindrical surface shape around an axis, the length L can be parallel to the axis. As will be presented in further detail below, in some embodiments, the structure holding the pulling lip 136 relative to the male fit perimeter 152 can do so with a transversal offset 62, 162 between the two. Transversal, in this context, means transversal to the length L. Otherwise said, in an axisymmetric geometry, the transversal orientation can be radial, and the peripheral orientation can be circumferential. The pulling lip 36, 136 typically spans both transversally, to allow a corresponding portion of the tool to grab onto it, and peripherally, to allow the pulling tool to distribute the lengthwisely oriented pulling force around the periphery. Depending on the embodiment, the pulling lip 36, 136 can span peripherally continuously, such as having an annular shape, or discontinuously, such as by having a plurality of peripherally distributed tooth-like features. A continuous configuration can be preferred in some embodiments.

In the illustrated embodiment, the first component 20 is a flow restrictor 120 and the second component 22 is a hollow shaft 122. The flow restrictor 120 is engaged radially internally within the hollow shaft 122, and its male fit perimeter 154 can be referred to as spigot 132. The spigot 132 has an annular, axially oriented, radially-outer, engagement surface forming the male fit perimeter 154, which has a diameter which is slightly larger than the radially-inner diameter of the corresponding engagement surface forming the female fit perimeter 152, of the hollow shaft 122, creating the interference fit 126. The degree of interference is designed to be within an elastic deformation capacity of the components such that the spigot 132 can be press-fitted within the female fit perimeter 152 of the hollow shaft 122, yielding a high friction force bond between the components given the reverting force stemming from the forced elastic deformation of both components.

In some embodiments, such as the one illustrated, the tight fit 126 can be considered to be a suitable assembly technique between the components. In particular, in this example, the flow restrictor 120 can only be removed by exerting an axial force between the restrictor 120 and the shaft 122 which is greater that the resistance friction force, and the expected axial loads between the components during operation of the gas turbine engine can be significantly lower than the resistance friction force, ensuring that the components do not become disassembled without specific intent. In this embodiment the flow restrictor 120 can be used to allow a controlled air flow through the shaft 122 at different operating conditions in order to provide sufficient cooling flow to cool down transmission components. In this context, the flow restrictor has streamlined, progressively reducing and then increasing diameter along the axis, which can create a Venturi. It will be noted here that interference fits can be used to assemble other components than flow restrictors to components other than shafts, in alternate embodiments, and that the specific case of the flow restrictor 120 and shaft 122 is presented here solely as an example. In the specific example of the flow restrictor 120 and shaft 122 illustrated, the male fit perimeter 154 and the female fit perimeter 152 are axisymmetric (conical surfaces), centered around the main axis 11 of the gas turbine engine, though it will be understood that in alternate embodiment, these components can be axisymmetric around an axis other than the main axis 11, or have non axisymmetric shapes.

The static friction-based resistance force RF which needs to be overcome to pull the spigot 132 out can have a relatively precisely known value which can depend of the design configuration of the interference fit, including tolerances on the two perimeters 152, 154, and total surface area of engagement (length-wise and perimeter-wise, or more specifically, in the case of an axisymmetric interference fit, axially and circumferentially), and the elastic deformation behavior of the components, which can depend on the nature of their material. Accordingly, if one assumes that the components do not deform under the pulling force PF elsewhere than in the immediate vicinity of the engaged perimeters, and that the pulling force PF is exerted purely axially, one can conclude that the pulling operation needs to be performed at a pulling force PL which exceeds the resistance friction force RF to achieve disassembly. It will be understood that the engaged components will be subjected to internal stresses during the pulling operation, where the pulled component will be subjected to internal tension stress between the pulling feature 36, 136 and the interference fit 26, 126, and the pushed component 22, 122 will be subjected to internal compressive stress between the pushing feature 42 and the interference fit 26, 126. To achieve full functionality, each component must be able to withstand the respective disassembly stresses, which may, in some embodiments, impose design constraints especially on the smaller one of the two components, leading to additional structure, and associated additional weight and cost. For instance, the pulling feature 36, 136 may be the weakest component and require to be strengthened by an increase in size, and therefore an otherwise unproductive increase in weight. Similar stresses can also exist during the assembly operation.

Therefore, on one hand, one may wish to design the components in a manner for the resistance force RF to be minimized, but on the other hand, the resistance force RF may need to remain sufficiently high to satisfy other design constraints, such as ensuring that the components do not become disassembled even in worst case/extreme scenarios within the operating envelope. The latter consideration can impose a minimal amount of structure and weight in the components, which may be more costly to achieve in the lighter one of the components than in the heavier one. Accordingly, weight reduction of one or both of the interference fitted components can be limited by the practical consideration of remove-ability, and more specifically by a requirement of resistance to internal compressive or tension stress expected during one or both of the press-fitting or pulling assembly/disassembly operations.

It was found that, at least in some embodiments, the required amount of pulling force PF for the disassembly operation could be made lower than the static resistance friction force exhibited by the assembly when no pulling force is being exerted onto the components. Indeed, this can be achieved, for instance, by designing one of the components with a pulling feature 36, 136 which is transversally offset 62, 162 (i.e. radially offset in an axisymmetric design) from the interference fit 26, 126, and with a structure 60, 160 defining a load path extending between the pulling feature 36, 136 and the fit perimeter 30, 154 having at least a partially transversally-oriented bending portion 164 bridging the offset 62, 162. The bending portion 164 can extends at least partially radially, and can also extend partially axially. The bending portion 164 can be made relatively thin, and specifically be designed for bending lengthwisely (e.g. axially) when the pulling force PF is applied.

Figure 4:
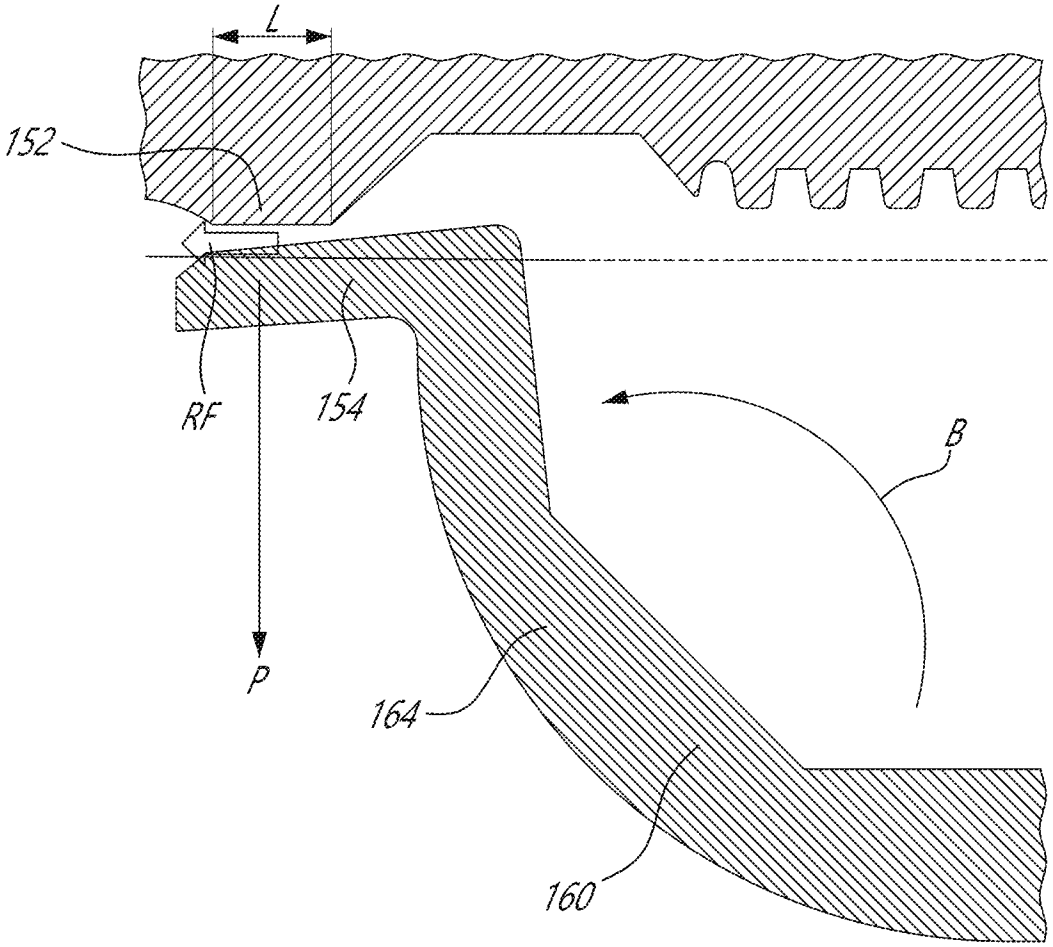
FIG. 4 shows an enlarged portion of FIG. 3 further schematizing deformation of the components during disassembly, in an exaggerated manner to facilitate understanding.

As schematized in exaggerated form in FIG. 4, the lengthwise bending B of the bending portion 164 can lead to a pivoting P of the fit perimeter 154 (e.g. transversally inward movement) which can alleviate the compression forces otherwise existing between the engaged perimeters 152, 154 and thus reduce the current, actual, amount of resistance friction force RF at least somewhat proportionally to the amount of pulling force PF, in a disassembly load reduction effect. The resistance force RF is oriented along the length L of the interference fit, and can decrease upon elastic bending of the bending portion 164.

Figure 5:
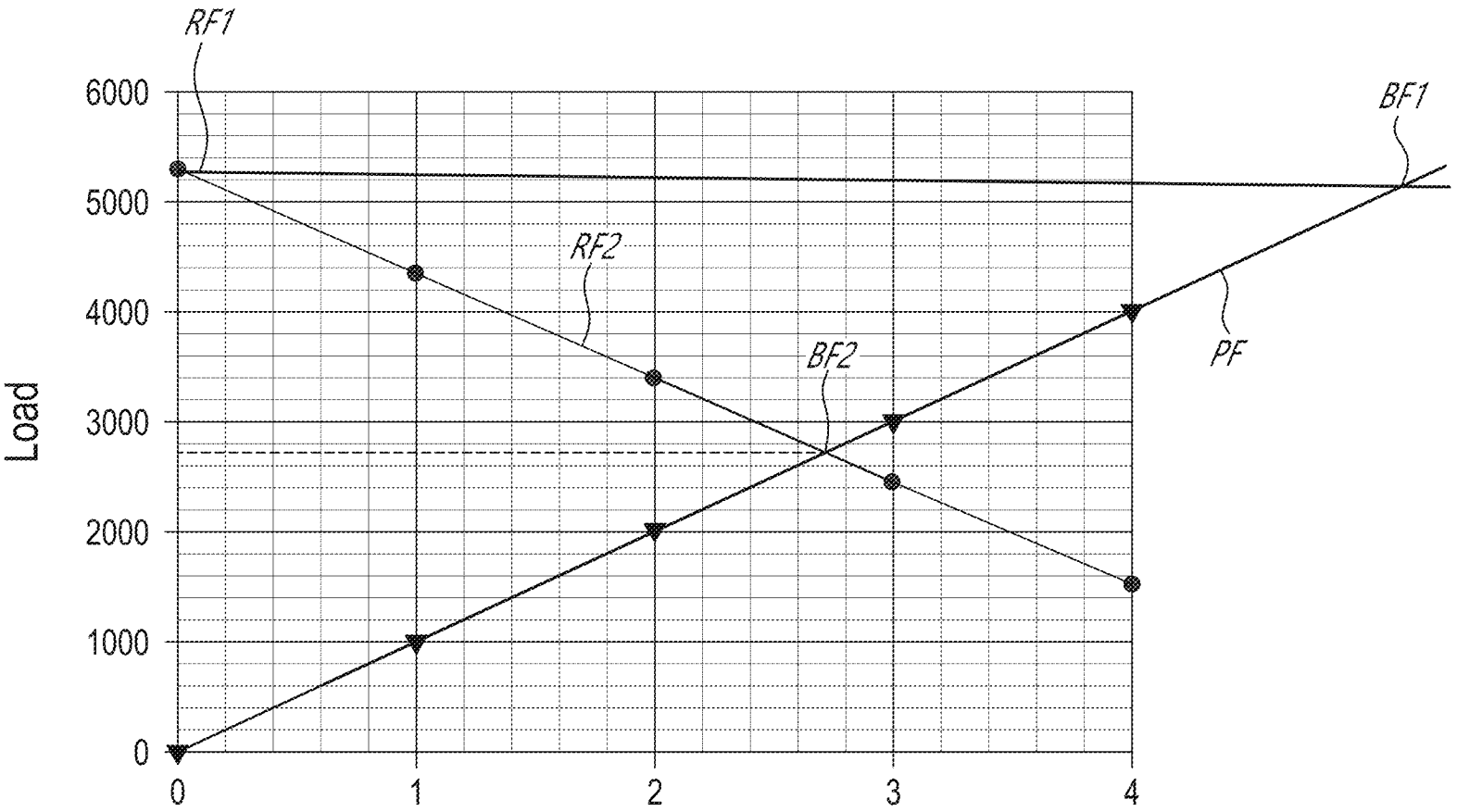
FIG. 5 is a graph showing two possible ways of modeling forces during the disassembly operation.
Figure 8:
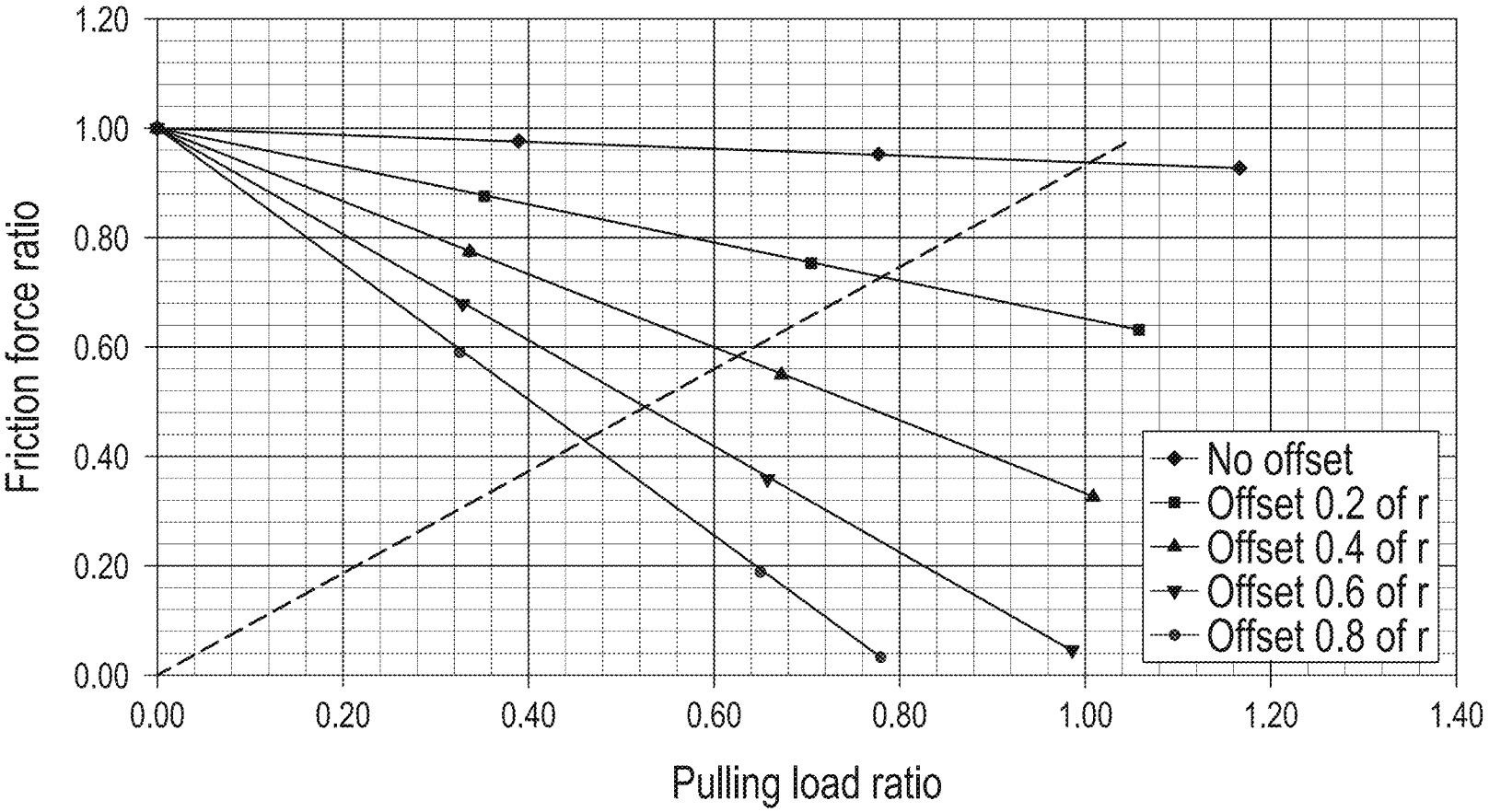

As explained in reference to FIG. 5, in a first embodiment where no radial offset/elastic bending occurs, or where any elastic bending effect is abstracted from the modelization, the resistance force RF1 does not significantly vary during the increase in pulling force PF, represented as the X-axis, and the required amount of pulling force PF to reach the breakaway/disassembly, indicated as breakage force BF1, corresponds roughly to the resistance friction force RF1 exhibited by the assembly in static conditions. In a second embodiment where the radial offset 62, 162 is present, and where the elastic bending B leading to the disassembly load reduction occurs, the exhibited resistance friction force RF2 varies in real time as a function of the bending B, which is affected by the current value of the pulling force PF. The required pulling force to achieve disassembly, indicated as breakaway force BF2, then roughly corresponds to the intersection of the two lines, which, as can be seen in this graph, can be significantly lower than the exhibited resistance friction RF1 exhibited in static conditions (without pulling). From the interference-fit assembly perspective, and notwithstanding other considerations which may exist in the overall design, the interference-fitted components now only need to exhibit a structural resistance corresponding to internal stresses corresponding to tension (or compression) at the breakaway load BF2, which is significantly smaller than the internal stresses which would occur during tension or compression at a breakaway load BF1. Accordingly, this can allow, in some embodiments, to reduce the weight and costs of one or both components without significant expense in terms of durability and reliability, and in some cases by providing the further advantage of simplifying assembly.

Simulation results are presented in FIG. 6. The simulations considered that, in practice, there can be a slight variation in the exhibited friction force Y axis as a function of pulling force X axis even in a scenario with an offset of 0 (no offset), though this can be of below 10%. Moreover, the exhibited reduction in resistance friction force RF as a function of the pulling force PF can significantly become more pronounced as the offset becomes more pronounced. In FIG. 6 the resistance force curves corresponding to scenarios of no offset, offset of 0.2% of fit radius, offset of 0.4% of fit radius, offset of 0.6% of fit radius and offset of 0.8% of fit radius are presented, for a cylindrical surface interference fit design. As presented in the FIG. 6, the breakaway force can be of less than 80% of the resistance friction force which can be exhibited by the interference fit without deformation, less than 60%, and even less than 50%, with a breakaway force representing roughly 45% of the no-offset breakaway force when the offset is of about 0.8 times the radius of the interference fit. Accordingly, in some embodiments, the resistance force can decrease by at least 20% upon elastic bending of the bending portion. In some embodiments, the resistance force can decrease by at least 40% upon elastic bending of the bending portion, and in some embodiments, the resistance force can decrease by at least 50% upon elastic bending of the bending portion. In some embodiments, the transversal offset can be of at least 15% of the radius of the interference fit's cylindrical surface, and in some embodiments, the transversal offset can be of at least 30% of the radius.

In the embodiment presented above, one of the two components is designed to exhibit the bending behavior during pulling, whereas the other component has no offset. The component designed to exhibit the bending behavior is radially internal to the component having no offset in the assembly, and the offset is radially inward. The component designed to exhibit the bending behavior is pulled relative to the other component. In alternate embodiments, the radially internal component can be pushed instead of pulled relative to the radially external component. Moreover, the radially external component can also be designed to exhibit a bending behavior, and thus be designed with an offset, and the radially internal component can be simultaneously designed with an offset, or designed without an offset.

In an embodiment such as illustrated, it will be noted that it was selected to design the structure which protrudes radially inwardly from the pulling feature, between the pulling feature and the tight fit. Accordingly, the bending portion 164 has a transversal dimension which exceeds the dimension of the transversal offset 162 by an extent 165. This optional feature can amplify the bending effect and can be favored in some embodiments, thought it is optional, and can be absent from some alternate embodiments. In alternate embodiments where a component having the offset is radially external to the other component, the structure can protrude radially outwardly from the pulling (or pushing) feature to achieve a similar effect of bending amplification.

Figure 7:
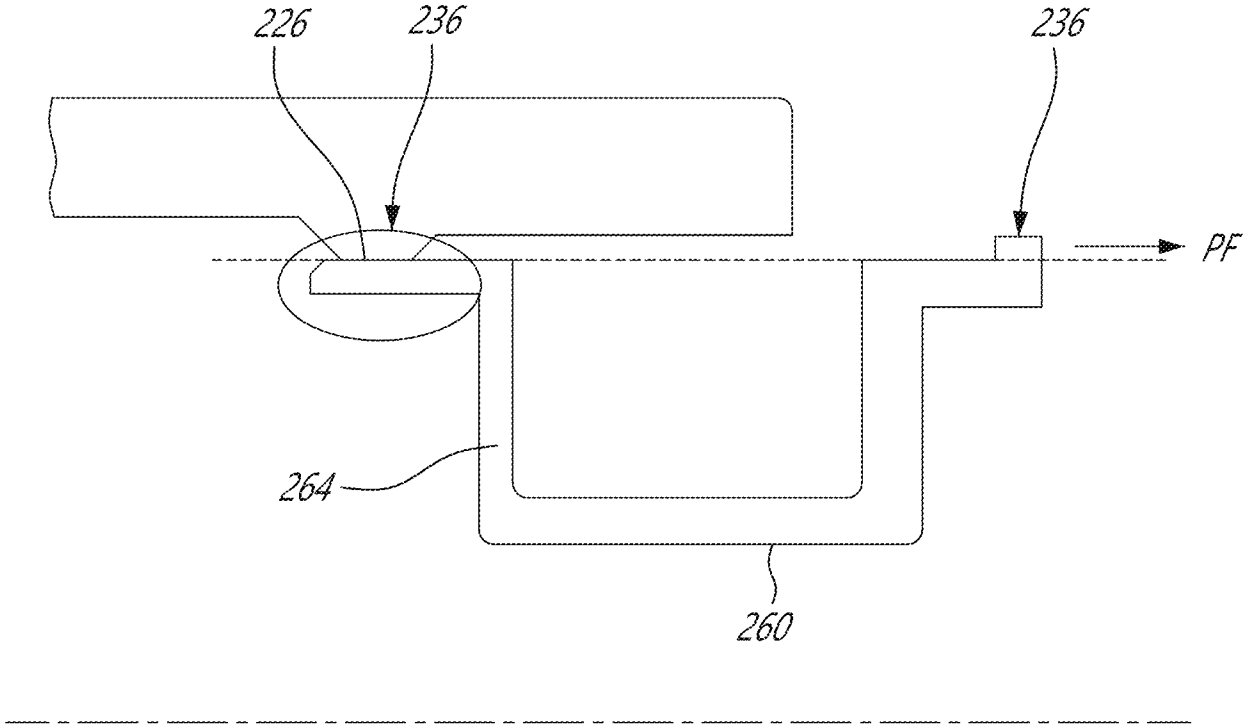
FIG. 7 is a cross-sectional view of a third embodiment of two interference-fitted components.

It will be noted that the transversal offset 162 between the pulling lip 136 and the spigot 132 is optional. Indeed, in an embodiment such as presented in FIG. 7, the spigot 232 can be axially aligned with the pulling lip 236, such as to provide a zero, or otherwise negligible transversal offset. The structure 260 holding the pulling lip 236 away from the interference fit 226, deviates transversally away from the radial position of the interference fit 226 and pulling feature 236, and defines a deviating and returning load path extending between the pulling feature 236 and the fit perimeter. The structure 260 has at least one partially transversally-oriented bending portion 264 bridging the transversal extent of the deviation, and the bending portion 264 can bend so as to relieve the strength of the interference fit similarly to the way it works in the embodiment illustrated in FIG. 3. Indeed, the structure 260 has a radially outward extending portion and a radially inward extending portion, and can have an axially extending portion therebetween. In this embodiment, the bending portion 264 can be the radially inward extending portion and specifically be designed thinner than the radially outward extending portion. In alternate embodiments, the radially outward extending portion can be designed thinner for being used for bending, or optionally, both the radially outward extending portion and the radially inward extending portion can be designed for use as bending portions.

It will also be noted that as known in the art, the male fit perimeter and female fit perimeter can each terminate, in the lengthwise/axial orientation, at a corresponding chamfered end. The chamfered end can facilitate the assembly step, during which both chamfered ends become engaged against one another before substantial pushing is applied. This latter step involves chamfered ends which are directed opposite one another, though in some embodiments, both ends of both fit perimeters can be chamfered.

As expressed above, flexion of the structure can be harnessed to reduce the amount of friction force required to achieve disassembly. The offset between the tight fit and the pulling feature load path can create a bending moment when the pulling load is applied. This bending can cause local deformation and the contact diameter can move radially inwardly (i.e. shrink) which can lead to fit reduction and, therefore, reduction of the friction force. In other embodiments, other offset feature(s) intended to impose deformation at the fit diameter for tight fit reduction which in turn reduces the friction force in the fit and, therefore, disassembly load, can be used.

The embodiments described in this document provide non-limiting examples of possible implementations of the present technology. Upon review of the present disclosure, a person of ordinary skill in the art will recognize that changes may be made to the embodiments described herein without departing from the scope of the present technology. For example, depending on the embodiment, the pulling lip can be integrated to the component having the male fit perimeter or to the component having the female fit perimeter. Of course, although only one pulling lip is typically used during a pulling operation, the other one of the components can have another pulling lip for other purposes. The offset is in the orientation opposite to the other one of the components (the one that is used to push against with the tool). If the pulling lip forms part of the component having the male fit perimeter, the offset can be directed away from the female fit perimeter. Similarly, in alternate embodiments, offset, material elasticity, and/or thickness of the bending portion can be varied to control the extent of the bending, and in some embodiments, it may also be possible to vary the direction of disassembly load application. Yet further modifications could be implemented by a person of ordinary skill in the art in view of the present disclosure, which modifications would be within the scope of the present technology.

The invention claimed is:

1. A gas turbine engine assembly comprising:

a first component having a male fit perimeter;

a second component having a female fit perimeter forming an interference fit with the male fit perimeter, the interference fit having a fit perimeter and a length;

one of the first component and the second component having a pulling lip spanning transversally, relative to an orientation of the length, and further spanning peripherally, and a structure of the one of the first component and the second component holding the pulling lip away from the interference fit, the structure having a bending portion extending at least partially transversally away from the pulling lip relative to the orientation of the length as the bending portion extends away from the interference fit.

2. The gas turbine engine of claim 1 wherein the structure holds the pulling lip at a location transversally offset from the interference fit by a transversal offset.

3. The assembly of claim 2 wherein the first component has the pulling lip, the location being transversely offset inward of the female fit perimeter.

4. The assembly of claim 1 wherein the interference fit has a resistance force oriented along the length between the fit perimeters, the resistance force decreasing upon elastic bending of the bending portion.

5. The assembly of claim 4 wherein the resistance force decreases by at least 20% upon elastic bending of the bending portion.

6. The assembly of claim 5 wherein the resistance force decreases by at least 40% upon elastic bending of the bending portion.

7. The assembly of claim 2 wherein the bending portion has a transversal dimension transversally exceeding a dimension of the transversal offset.

8. The assembly of claim 2 wherein the interference fit defines a cylindrical surface.

9. The assembly of claim 8 wherein the transversal offset is of at least 15% of a radius of the cylindrical surface.

10. The assembly of claim 9 wherein the transversal offset is of at least 30% of a radius of the cylindrical surface.

11. The assembly of claim 1 wherein the pulling lip forms a continuous annular shape around an axis, said spanning transversally including spanning radially relative the axis, said spanning peripherally including spanning circumferentially relative the axis.

12. The assembly of claim 1 wherein the male fit perimeter and the female fit perimeter each terminate at a chamfered end along the orientation of the length, the chamfered end of the male fit perimeter being directed opposite the chamfered end of the female fit perimeter relative to the length.

13. The assembly of claim 2 wherein the first component is a flow restrictor having an axisymmetric shape defined around an axis, and an internal aperture smoothly reducing in size and then smoothly increasing in size along the axis.

14. The assembly of claim 1 wherein the other one of the first component and the second component has an abutment surface, the pulling lip configured to receive a pulling component of a puller, the abutment surface configured to abuttingly receive a housing of the puller.

15. The assembly of claim 4 wherein the elastic bending can stem from pulling the pulling lip relative the other one of the first component and the second component.

16. A method of disassembling a gas turbine engine assembly comprising:

exerting a pulling force to a pulling lip of a first component relative to a second component, the first component having a fit perimeter interference fitted with a fit perimeter of the second component, said pulling force bending a bending portion of a structure extending between the pulling lip and the interference fit, the bending portion extending at least partially transversally away from the pulling lip relative to an orientation of a length of the interference fit as the bending portion extends away from the interference fit, said bending moving the fit perimeter of the first component away from the fit perimeter of the second component, thereby weakening the interference fit, and removing the first fit perimeter from the second fit perimeter while the interference it is weakened.

17. The method of claim 16 wherein said weakening the interference fit includes reducing a lengthwise resistance force of the interference fit by at least 20%.

18. The method of claim 16 wherein said weakening the interference fit includes reducing a lengthwise resistance force of the interference fit by at least 40%.

19. The method of claim 16 wherein said weakening the interference fit includes reducing a lengthwise resistance force of the interference fit by at least 50%.

20. A gas turbine engine comprising:

a first component having a male fit perimeter;

a second component having a female fit perimeter forming an interference fit with the male fit perimeter, the interference fit having a fit perimeter and a length;

one of the first component and the second component having a pulling lip spanning transversally, relative to an orientation of the length, and further spanning peripherally; and a structure of the one of the first component and the second component holding the pulling lip at a location transversally offset from the interference fit relative to the orientation of the length, the structure having a bending portion extending at least partially transversally away from the pulling lip relative to the orientation of the length as the bending portion extends away from the interference fit.

* * * * *